US005683825A

United States Patent [19]

Bruce et al.

[11] Patent Number: 5,683,825

[45] Date of Patent: Nov. 4, 1997

[54] THERMAL BARRIER COATING RESISTANT TO EROSION AND IMPACT BY PARTICULATE MATTER

[75] Inventors: Robert W. Bruce, Loveland; Jon C. Schaeffer, Milford, both of Ohio; Mark A. Rosenzweig, Waldorf, Md.; Rudolfo Viguie; David V. Rigney, both of Cincinnati, Ohio; Antonio F. Maricocchi, Loveland, Ohio; David J. Wortman, Hamilton, Ohio; Bangalore A. Nagaraj, West Chester, Ohio

[73] Assignee: General Electric Company, Cincinnati, Ohio

[21] Appl. No.: 581,819

[22] Filed: Jan. 2, 1996

[51] Int. Cl.[6] ..... B32B 15/04

[52] U.S. Cl. ..... 428/698; 428/697; 428/701; 428/702; 428/472; 427/248.1; 427/249; 501/103; 501/152

[58] Field of Search ..... 428/698, 697, 428/701, 702, 472; 501/152, 103; 427/249, 248.1

[56] References Cited

U.S. PATENT DOCUMENTS

| | | | |
|---|---|---|---|
| 4,055,705 | 10/1977 | Stecura et al. | 428/633 |
| 4,249,913 | 2/1981 | Johnson et al. | 51/295 |
| 4,321,310 | 3/1982 | Ulion et al. | 428/612 |
| 4,321,311 | 3/1982 | Strangman | 428/623 |
| 4,335,190 | 6/1982 | Bill et al. | 428/623 |
| 4,402,992 | 9/1983 | Liebert | 427/34 |
| 4,414,239 | 11/1983 | Ulion et al. | 427/248.1 |
| 4,495,907 | 1/1985 | Kamo | 501/152 |
| 4,503,130 | 3/1985 | Bosshart et al. | 428/623 |
| 4,525,464 | 6/1985 | Claussen et al. | 501/103 |
| 4,588,607 | 5/1986 | Matarese et al. | 427/34 |
| 4,676,994 | 6/1987 | Demaray | 427/42 |
| 4,714,624 | 12/1987 | Naik | 427/34 |
| 4,738,227 | 4/1988 | Kamo et al. | 123/23 |
| 4,761,346 | 8/1988 | Naik | 428/627 |
| 4,774,150 | 9/1988 | Amano et al. | 428/690 |
| 4,808,487 | 2/1989 | Gruenr | 428/610 |
| 4,822,689 | 4/1989 | Fukubayashi et al. | 428/472 |

FOREIGN PATENT DOCUMENTS 2 252 567 9/1994 United Kingdom .

*Primary Examiner*—Archene Turner

*Attorney, Agent, or Firm*—Andrew C. Hess; David L. Narciso

[57] ABSTRACT

A thermal barrier coating adapted to be formed on an article subjected to a hostile thermal environment while subjected to erosion by particles and debris, as is the case with turbine, combustor and augmentor components of a gas turbine engine. The thermal barrier coating is composed of a metallic bond layer deposited on the surface of the article, a ceramic layer overlaying the bond layer, and an erosion-resistant composition dispersed within or overlaying the ceramic layer. The bond layer serves to tenaciously adhere the thermal insulating ceramic layer to the article, while the erosion-resistant composition renders the ceramic layer more resistant to erosion. The erosion-resistant composition is either alumina ($Al_2O_3$) or silicon carbide (SiC), while a preferred ceramic layer is yttria-stabilized zirconia (YSZ) deposited by a physical vapor deposition technique to have a columnar grain structure.

20 Claims, 2 Drawing Sheets

THERMAL BARRIER COATING RESISTANT TO EROSION AND IMPACT BY PARTICULATE MATTER

This invention relates to thermal barrier coatings for components exposed to high temperatures, such as the hostile thermal environment of a gas turbine engine. More particularly, this invention is directed to a thermal barrier coating that includes a thermal-insulating columnar ceramic layer, the thermal barrier coating being characterized by enhanced resistance to erosion as a result of an erosion-resistant composition that forms a physical barrier over the columnar ceramic layer, or that is dispersed in or forms a part of the columnar ceramic layer, so as to render the ceramic layer more resistant to erosion.

BACKGROUND OF THE INVENTION

Higher operating temperatures of gas turbine engines are continuously sought in order to increase their efficiency. However, as operating temperatures increase, the high temperature durability of the components of the engine must correspondingly increase. Significant advances in high temperature capabilities have been achieved through formulation of nickel and cobalt-base superalloys, though such alloys alone are often inadequate to form components located in certain sections of a gas turbine engine, such as the turbine, combustor and augmentor. A common solution is to thermally insulate such components in order to minimize their service temperatures. For this purpose, thermal barrier coatings (TBC) formed on the exposed surfaces of high temperature components have found wide use.

Thermal barrier coatings generally entail a metallic bond layer deposited on the component surface, followed by an adherent ceramic layer that serves to thermally insulate the component. Metallic bond layers are formed from oxidation-resistant alloys such as MCrAlY where M is iron, cobalt and/or nickel, and from oxidation-resistant intermetallics such as diffusion aluminides and platinum aluminides, in order to promote the adhesion of the ceramic layer to the component and prevent oxidation of the underlying superalloy. Various ceramic materials have been employed as the ceramic layer, particularly zirconia ($ZrO_2$) stabilized by yttria ($Y_2O_3$), magnesia (MgO) or another oxide. These particular materials are widely employed in the art because they can be readily deposited by plasma spray, flame spray and vapor deposition techniques, and are reflective to infrared radiation so as to minimize the absorption of radiated heat by the coated component, as taught by U.S. Pat. No. 4,055,705 to Stecura et al.

A significant challenge of thermal barrier coating systems has been the formation of a more adherent ceramic layer that is less susceptible to spalling when subjected to thermal cycling. For this purpose, the prior art has proposed various coating systems, with considerable emphasis on ceramic layers having enhanced strain tolerance as a result of the presence of porosity, microcracks and segmentation of the ceramic layer. Microcracks generally denote random internal discontinuities within the ceramic layer, while segmentation indicates the presence of microcracks or crystalline boundaries that extend perpendicularly through the thickness of the ceramic layer, thereby imparting a columnar grain structure to the ceramic layer. As taught by U.S. Pat. No. 4,321,311 to Strangman, a zirconia-base coating having a columnar grain structure is able to expand without causing damaging stresses that lead to spallation, as evidenced by the results of controlled thermal cyclic testing. As further taught by Strangman, a strong adherent continuous oxide surface layer is preferably formed over a MCrAlY bond layer to protect the bond layer against oxidation and hot corrosion, and to provide a firm foundation for the columnar grain zirconia coating.

While zirconia-base thermal barrier coatings, and particularly yttria-stabilized zirconia (YSZ) coatings having columnar grain structures, are widely employed in the art for their desirable thermal and adhesion characteristics, such coatings are susceptible to erosion and impact damage from particles and debris present in the high velocity gas stream of a gas turbine engine. Furthermore, adjoining hardware within a gas turbine engine may sufficiently rub the thermal barrier coating to expose the underlying metal substrate to oxidation. Consequently, there is a need for impact and erosion-resistant thermal barrier coating systems. For relatively low temperature applications such as gas turbine engine compressor blades, U.S. Pat. No. 4,761,346 to Naik teaches an erosion-resistant coating composed of an interlayer of a ductile metal from the Group VI to Group VIII elements, and a hard outer layer of a boride, carbide, nitride or oxide of a metal selected from the Group III to Group VI elements. According to Naik, the ductile metal serves as a crack arrestor and prevents diffusion of embrittling components into the underlying substrate from the hard outer layer. However, because the ductile metal layer is a poor insulating material, the erosion-resistant coating taught by Naik is not a thermal barrier coating, and therefore is unsuitable for use in higher temperature applications such as high and low pressure turbine nozzles and blades, shrouds, combustor liners and augmentor hardware of gas turbine engines.

Thermal barrier coating systems suggested for use in higher temperature applications of a gas turbine engine have often included columnar YSZ ceramic coatings deposited by physical vapor deposition (PVD) techniques. For example, U.S. Pat. No. 4,916,022 to Solfest et al. teach a PVD-deposited columnar YSZ ceramic coating that includes a titania-doped interfacial layer between the YSZ ceramic coating and an underlying metallic bond layer in order to reduce oxidation of the bond layer, thereby improving the resistance of the ceramic coating to spallation. Solfest et al. suggest densifying the outer surface of the ceramic coating by laser glazing, electrical biasing and/or titania ($TiO_2$) doping in order to promote the erosion resistance of the ceramic coating. However in practice, additions of titania to a columnar YSZ ceramic coating have been shown to have the opposite effect—namely, a decrease in erosion resistance of the YSZ ceramic coating.

In contrast, the prior art pertaining to internal combustion engines has suggested a plasma sprayed (PS) zirconia ceramic coating protected by an additional wear-resistant outer coating composed of zircon ($ZrSiO_4$) or a mixture of silica ($SiO_2$), chromia ($Cr_2O_3$) and alumina ($Al_2O_3$) densified by a chromic acid treatment, as taught by U.S. Pat. No. 4,738,227 to Kamo et al. Kamo et al. teach that their wear-resistant outer coating requires a number of impregnation cycles to achieve a suitable thickness of about 0.127 millimeter. While the teachings of Kamo et al. may be useful for promoting a more wear-resistant component, the resulting densification of the ceramic coating increases the thermal conductivity of the coating, and would nullify the benefit of using a columnar grain structure. Consequently, the teachings of Kamo et al. are incompatible with thermal barrier coatings for use in high temperature applications of a gas turbine engine.

As is apparent from the above, though improvements in resistance to spallation have been suggested for thermal barrier coatings for gas turbine engine components, such improvements tend to degrade the insulative properties and/or the erosion and wear resistance of such coatings. In addition, though improvements in wear resistance have been achieved for ceramic coatings intended for applications other than thermal barrier coatings, such improvements would significantly compromise the thermal properties required of thermal barrier coatings. Accordingly, what is needed is a thermal barrier coating system characterized by the ability to resist wear and spallation when subjected to impact and erosion in a hostile thermal environment. Preferably, such a coating system would be readily formable, and employ an insulating ceramic layer deposited in a manner that promotes both the impact and erosion resistance and the thermal insulating properties of the coating.

SUMMARY OF THE INVENTION

It is an object of this invention to provide a thermal barrier coating for an article exposed to a hostile thermal environment while simultaneously subjected to impact and erosion by particles and debris.

It is another object of this invention that such a thermal barrier coating includes an insulating ceramic layer characterized by microcracks or crystalline boundaries that provide strain relaxation within the coating.

It is a further object of this invention that such a thermal barrier coating includes an impact and erosion-resistant composition dispersed within or overlaying the ceramic layer, so as to render the ceramic layer more resistant to erosion.

It is yet another object of this invention that the processing steps by which the coating is formed are tailored to also promote the impact and erosion resistance of the coating.

The present invention generally provides a thermal barrier coating which is adapted to be formed on an article subjected to a hostile thermal environment while subjected to erosion by particles and debris, as is the case with turbine, combustor and augmentor components of a gas turbine engine. The thermal barrier coating is composed of a metallic bond layer formed on the surface of the article, a ceramic layer overlaying the bond layer, and an erosion-resistant composition dispersed within or overlaying the ceramic layer. The bond layer serves to tenaciously adhere the thermal insulating ceramic layer to the article, while the erosion-resistant composition renders the ceramic layer more resistant to impacts and erosion. The erosion-resistant composition is either alumina ($Al_2O_3$) or silicon carbide (SiC), while a preferred ceramic layer is yttria-stabilized zirconia (YSZ) deposited by a physical vapor deposition technique to produce a columnar grain structure.

According to this invention, thermal barrier coatings modified to include one of the erosion-resistant compositions of this invention have been unexpectedly found to result in erosion rates of up to about 50 percent less than columnar YSZ ceramic coatings of the prior art, including the titania-doped YSZ ceramic coating taught by U.S. Pat. No. 4,916,022 to Solfest et al. Such an improvement is particularly unexpected if silicon carbide is used as the erosion-resistant composition, in that silicon carbide would be expected to react with the YSZ ceramic layer to form zircon, thereby promoting spallation of the ceramic layer. Further unexpected improvements in erosion resistance are achieved by increasing the smoothness of the bond layer and maintaining the article stationary during deposition of the ceramic layer.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

The present invention is generally directed to metal components that operate within environments characterized by relatively high temperatures, in which the components are subjected to a combination of thermal stresses and impact and erosion by particles and debris. Notable examples of such components include the high and low pressure turbine nozzles and blades, shrouds, combustor liners and augmentor hardware of gas turbine engines. While the advantages of this invention will be illustrated and described with reference to a component of a gas turbine engine, the teachings of this invention are generally applicable to any component in which a thermal barrier can be used to insulate the component from a hostile thermal environment.

Figure 1:
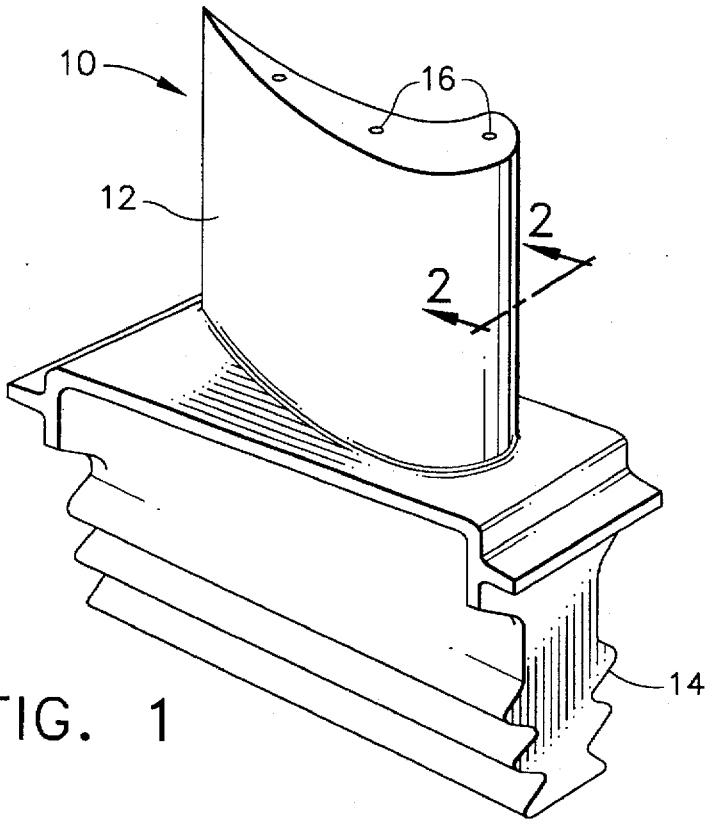
FIG. 1 shows a perspective view of a turbine blade having a thermal barrier coating.

To illustrate the invention, a turbine blade 10 of a gas turbine engine is shown in FIG. 1. As is generally conventional, the blade 10 may be formed of a nickel-base or cobalt-base superalloy. The blade 10 includes an airfoil section 12 against which hot combustion gases are directed during operation of the gas turbine engine, and whose surface is therefore subjected to severe attack by oxidation, corrosion and erosion. The airfoil section 12 is anchored to a turbine disk (not shown) through a root section 14. Cooling passages 16 are present through the airfoil section 12 through which bleed air is forced to transfer heat from the blade 10.

Figure 2:
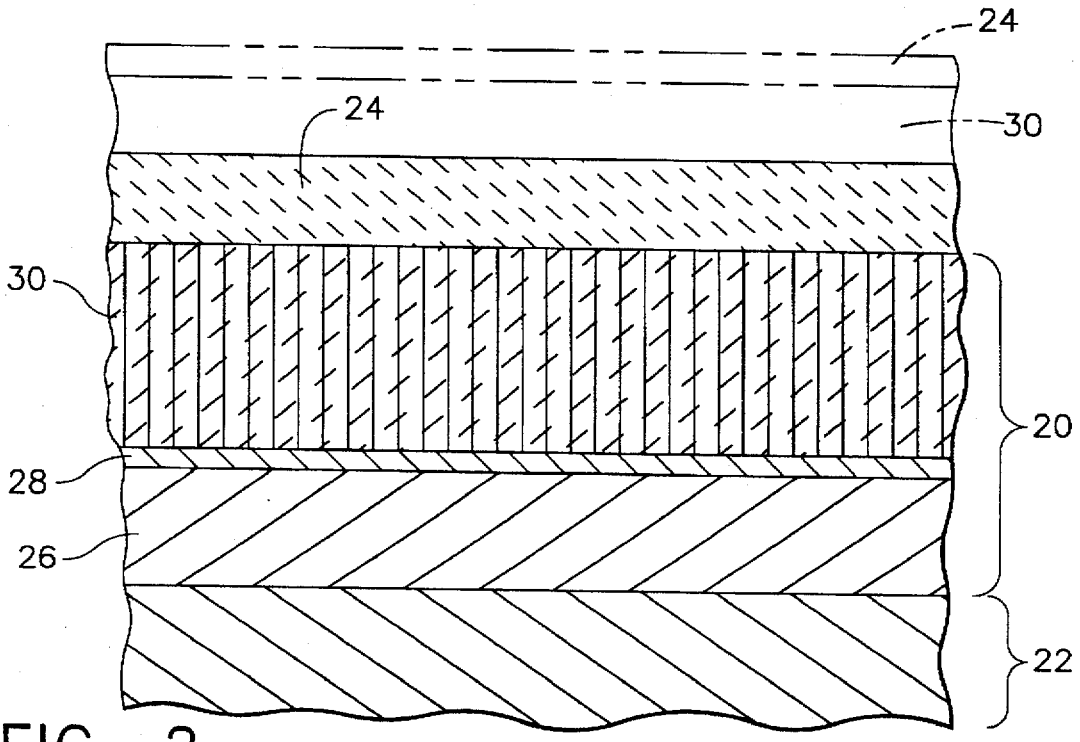
FIGS. 2 and 3 are an enlarged sectional views of the turbine blade of FIG. 1 taken along line 2—2, and represent thermal barrier coatings in accordance with first and second embodiments, respectively, of this invention.
Figure 3:
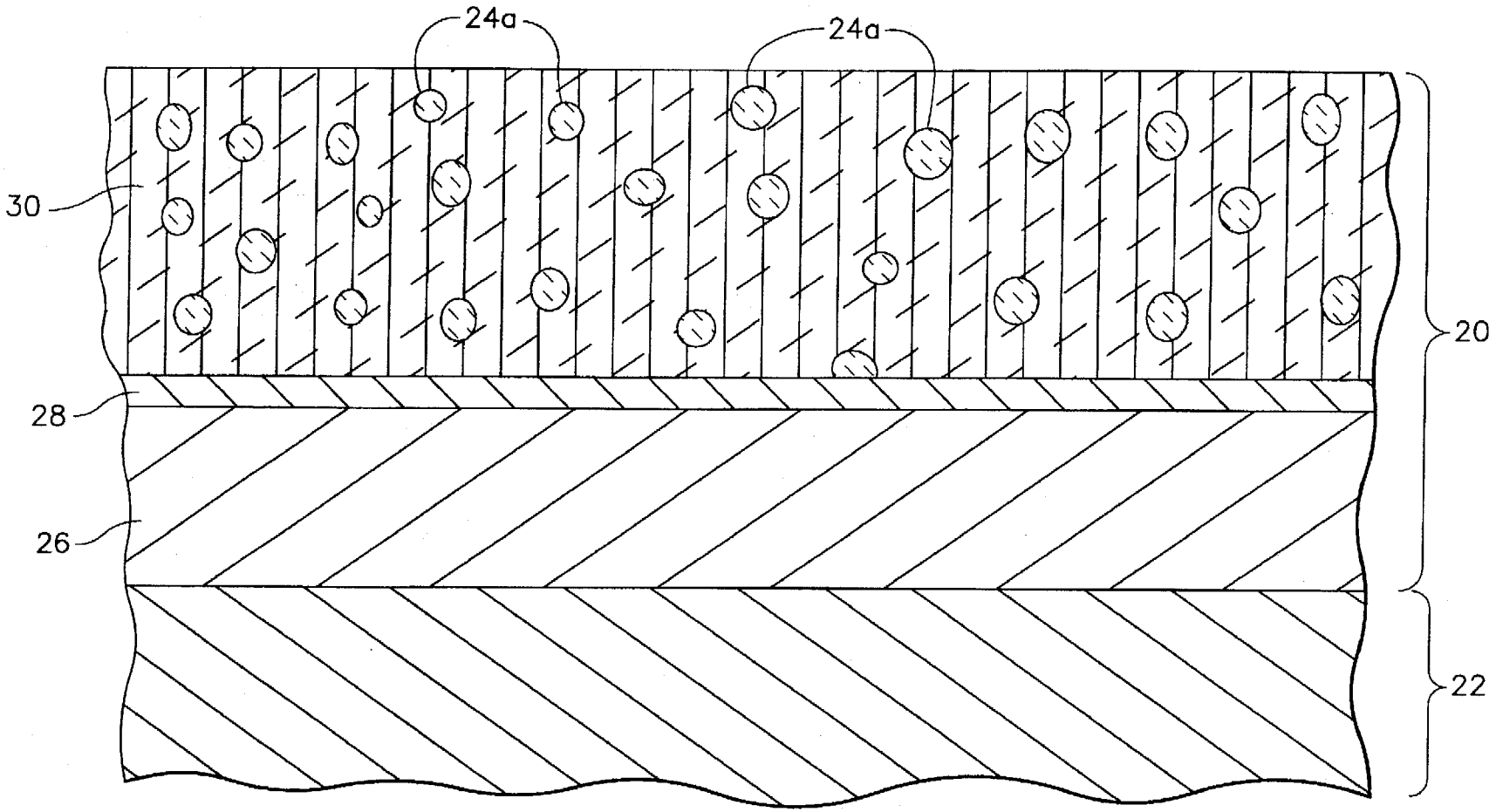

According to this invention, the airfoil section 12 is protected from the hostile environment of the turbine section by an erosion-resistant thermal barrier coating system 20, as represented in FIGS. 2 and 3. With reference to FIGS. 2 and 3, the superalloy forms a substrate 22 on which the coating system 20 is deposited. The coating system 20 is composed of a bond layer 26 over which a ceramic layer 30 is formed. The bond layer 26 is preferably formed of a metallic oxidation-resistant material, such that the bond layer 26 protects the underlying substrate 22 from oxidation and enables the ceramic layer 30 to more tenaciously adhere to the substrate 22. A preferred bond layer 26 is formed by a nickel-base alloy powder, such as NiCrAlY, or an intermetallic nickel aluminide, which has been deposited on the surface of the substrate 22 to a thickness of about 20 to about 125 micrometers. Following deposition of the bond layer 26, an oxide layer 28 such as alumina may be formed at an elevated processing temperature. The oxide layer 28 provides a surface to which the ceramic layer 30 can tenaciously adhere, thereby promoting the resistance of the coating system 20 to thermal shock.

A preferred method for depositing the bond layer 26 is vapor deposition for aluminide coatings or a low pressure plasma spray (LPPS) for a NiCrAlY bond coat, though it is foreseeable that other deposition methods such as air plasma spray (APS) or a physical vapor deposition (PVD) technique could be used. Importantly, the resulting bond layer 26 and/or the substrate 22 are polished to have an average surface roughness $R_a$ of at most about two micrometers (about eighty micro-inches), as measured in accordance with standardized measurement procedures, with a preferred surface roughness being at most about one micrometer $R_a$. In accordance with this invention, a smoother surface finish for the bond layer 26 promotes the erosion resistance of the ceramic layer 30, though the mechanism by which such an improvement is obtained is unclear. Notably, though U.S. Pat. No. 4,321,310 to Ulion et al. teaches that an improved thermal fatigue cycle life of a thermal barrier coating could be achieved by polishing the interface between the bond layer and its overlaying oxide layers, no indication of an improvement was taught or suggested for enhanced erosion resistance of the ceramic layer.

The ceramic layer 30 is deposited by a physical vapor deposition (PVD) in order to produce the desired columnar grain structure for the ceramic layer 30, as represented in FIG. 2. A preferred material for the ceramic layer 30 is an yttria-stabilized zirconia (YSZ), a preferred composition being about 6 to about 8 weight percent yttria, though other ceramic materials could be used, such as yttria, nonstabilized zirconia, or zirconia stabilized by ceria ($CeO_2$) or scandia ($Sc_2O_3$). The ceramic layer 30 is deposited to a thickness that is sufficient to provide the required thermal protection for the blade 10, generally on the order of about 75 to about 300 micrometers. According to this invention, the use of a PVD yttria-stabilized zirconia for the ceramic layer 30, and particularly a ceramic layer 30 deposited by electron beam physical vapor deposition (EBPVD), is an important aspect of the invention because of an apparent ability for such materials to resist erosion better than air plasma sprayed (APS) YSZ and other ceramics. Additionally, EBPVD ceramic coatings exhibit greater durability to thermal cycling due to their strain-tolerant columnar microstructure.

While PVD techniques employed in the art for depositing thermal barrier coatings conventionally entail rotating the targeted component, a preferred technique of this invention is to hold the component essentially stationary. According to this invention, maintaining the component stationary during the PVD process has been found to yield a denser yet still columnar grain structure, and results in a significant improvement in erosion resistance for the ceramic layer 30. Though the basis for this improvement is unclear, it may be that erosion resistance is enhanced as a result of the increased density of the ceramic layer 30.

To achieve a substantially greater level of erosion resistance, the ceramic layer 30 of this invention is protected by an impact and erosion-resistant composition that can either overlay the ceramic layer 30 as a wear coating 24 as shown in FIG. 2, or be co-deposited with or implanted in the ceramic layer 30 as discrete particles 24*a*, so as to be dispersed in the ceramic layer 30 as represented by FIG. 3. Further improvements in erosion resistance can be achieved in accordance with this invention by improving the surface finish of the EBPVD ceramic layer by a process such as polishing or tumbling prior to depositing the erosion-resistant composition.

The preferred method is to deposit the erosion-resistant composition as the distinct wear coating 24 represented by FIG. 2. By this method, the impact and erosion-resistant wear coating 24 can be readily deposited by EBPVD, sputtering or chemical vapor deposition (CVD) to completely cover the ceramic layer 30. Furthermore, the wear coating 24 provides a suitable base on which multiple alternating layers of the ceramic layer 30 and the wear coating 24 can be deposited, as suggested in phantom in FIG. 2, to provide a more gradual loss of both the erosion protection provided by the wear coating 24 and thermal protection provided by the ceramic layer 30.

According to this invention, erosion-resistant compositions compatible with the ceramic layer 30 include alumina and silicon carbide. As a discrete coating over the ceramic layer 30, alumina is preferably deposited to a thickness of about twenty to about eighty micrometers by an EBPVD technique, while silicon carbide is preferably deposited to a thickness of about ten to about eighty micrometers by chemical vapor deposition. Notably, while the prior art has suggested and often advocated the presence of a thin alumina layer (such as the oxide layer 28) beneath the ceramic layer of a thermal barrier coating system, the use of an alumina layer as an outer wear coating for a thermal barrier coating system has not. Generally, the lower coefficient of thermal expansion of alumina and silicon carbide would promote spallation if the entire coating 20 were composed of these dense, low expansion materials. In accordance with this invention, it is believed that use of an alumina or silicon carbide wear coating 24 over a columnar YSZ ceramic layer 30 enables strain to be accommodated while imparting greater impact and erosion resistance for the coating 20.

Furthermore, the use of silicon carbide as an outer wear surface for a thermal barrier coating system has not been suggested, presumably because silicon carbide is readily oxidized to form silicon dioxide, which reacts with yttria-stabilized zirconia to form zircon and/or yttrium silicites, thereby promoting spallation. Surprisingly, when deposited at the prescribed limited thicknesses, silicon carbide as the wear coating 24 does not exhibit this tendency, but instead has been found to form an adherent coating that fractures and expands with the columnar microstructure of the ceramic layer 30, and is therefore retained on the ceramic layer 30 as an erosion-resistant coating. Deposition techniques that deposit silicon carbide particles between columns of the columnar grain structure may promote spallation, and is to be avoided.

As noted above, FIG. 3 represents an embodiment of this invention in which the erosion-resistant composition is dispersed in the ceramic layer 30 as discrete particles 24*a*. Such a result can be achieved by co-depositing or implanting the erosion-resistant composition and the ceramic layer 30 using known physical vapor deposition techniques. With this approach, the preferred erosion-resistant composition is alumina in amounts of preferably not more than about eighty weight percent, and more preferably not more than about fifty weight percent, of the ceramic layer 30.

Comparative erosion tests were run to evaluate the effectiveness of the erosion-resistant compositions of this invention. One test involved preparing specimens of the nickel superalloy IN 601 by vapor phase aluminiding the surfaces of the specimens to a thickness of about fifty micrometers. An EBPVD columnar YSZ ceramic layer was then deposited to a thickness of about 130 micrometers (about 5 mils). Silicon carbide wear coatings of either about 13 micrometers (0.5 mil) or about 25 micrometers (1 mil) were then deposited on some of the specimens, while others were not further treated in order to establish a control group. Advantageously, the silicon carbide wear coatings mimicked the surface finish of the underlying ceramic layer, thereby avoiding the considerable difficulty that would be otherwise encountered to smooth the silicon carbide wear coating in preparation for a subsequently deposited layer.

The specimens were then erosion tested at room temperature for various durations with alumina particles directed from a distance of about ten centimeters at a speed of about six meters per second (about twenty feet per second) and at an angle of about ninety degrees to the surface of the specimens. After normalizing the results for the test durations used, the specimens with the silicon carbide wear coatings were found to exhibit an approximately 30 percent reduction in erosion depth and an approximately 50 percent reduction in weight loss as compared to the uncoated specimens of the control group.

A second series of tests involved preparing specimens of the nickel superalloy Rene N5, which for convenience are designated below as Groups A through E to distinguish the various processing methods employed. All specimens were vapor phase aluminided to a thickness of about fifty micrometers to form a bond layer.

Group A and B Specimens

Following deposition of the bond layer, and prior to deposition of an EBPVD columnar ceramic layer, the surface finishes of the bond layers for all specimens were determined. Specimens having a surface finish of about 2.4 micrometers $R_a$ (about 94 micro-inches $R_a$) were designated Group A, while the remaining specimens were polished to achieve a surface finish of about 1.8 micrometers $R_a$ (about 71 micro-inches $R_a$). An EBPVD columnar ceramic layer of 7 percent YSZ was then deposited on the specimens of Groups A and B to achieve a thickness of about 125 micrometers. Deposition was conducted while the specimens were rotated at a rate of about 6 rpm, which is within a range conventionally practiced in the art. The Group A and B specimens were then set aside for testing, while the remaining specimens underwent further processing.

Group C Specimens

In contrast to the specimens of Groups A and B (as well as Groups D, E and F), which were rotated at a rate of about six rpm during deposition of the ceramic layer, 7 percent YSZ ceramic layers were deposited on the Group C specimens while holding the specimens stationary. As with the EBPVD columnar ceramic layers of Groups A and B, the final thicknesses of the ceramic layers were about 125 micrometers.

Group D Specimens

Following deposition of a 7 percent YSZ ceramic layer having a thickness of about 25 micrometers, each of the Group D specimens underwent a second deposition process by which an alumina wear coating was formed. Each specimen was coated with an approximately 50 micrometers thick wear coating of alumina using EBPVD.

Group E Specimens

Alumina was co-deposited with a 7 percent YSZ ceramic layer on each of the Group E specimens. The thickness of the ceramic layer was about 125 micrometers. The alumina was co-deposited at one of two rates, with the lower rate (Group E1) achieving an alumina content of about 3 weight percent of the ceramic layer and the higher rate (Group E2) achieving an alumina content of about 45 weight percent.

All of the above specimens were then erosion tested in essentially the identical manner described for the specimens coated with silicon carbide wear coatings. The results of these tests are summarized below in Table I after being normalized for the test durations used, with the percent change in erosion being relative to the Group A specimens.

TABLE I

| Group | Condition Evaluated | Percent Change |
|---|---|---|
| A | Control | — |
| B | Bond layer surface finish | −14% |
| C | Rotation (stationary) | −27 |
| D | Alumina coating | −41 |
| E1 | Alumina disp. in YSZ (3%) | −51 |
| E2 | Alumina disp. in YSZ (45%) | −42 |

From the above, it is apparent that significant improvements in erosion resistance can be achieved by each of the above modifications. Most notably, the greatest improvement in erosion resistance corresponded to the presence of about 3 weight percent alumina dispersed in a columnar YSZ, the embodiment of this invention represented in FIG. 3. A significant decrease in erosion resistance was apparent as the level of alumina in the ceramic layer increased toward about 50 weight percent. Employing an alumina wear coating over a columnar YSZ ceramic coating, as represented in FIG. 2, also achieved a significant improvement in erosion resistance for the thermal barrier coating systems tested. In practice, an alumina wear coating over a columnar YSZ ceramic coating is preferred as a technique for achieving enhanced erosion resistance for thermal barrier coatings because of easier processing. Advantageously, the alumina wear coating also improves the resistance of the thermal barrier coating to chemical and physical interactions with any deposits that may occur during engine service.

Based on the above results, it is foreseeable that an optimal thermal barrier coating system could be achieved with a columnar YSZ ceramic layer 30 deposited using a physical vapor deposition technique, combined with a surface finish of about two micrometers $R_a$ or less for the bond layer 26 (as indicated by the Group B specimens), keeping the targeted specimen stationary during deposition of the ceramic layer 30 (as indicated by the Group C specimens), and providing alumina or silicon carbide in the form of either a coating over the ceramic layer 30 or a dispersion in the ceramic layer 30 (as indicated by the silicon carbide test specimens and the Group D and E specimens).

While our invention has been described in terms of a preferred embodiment, it is apparent that other forms could be adopted by one skilled in the art. Accordingly, the scope of our invention is to be limited only by the following claims.

What is claimed is:

1. An erosion-resistant thermal barrier coating formed on an article subjected to particulate impact erosion and wear, the thermal barrier coating comprising:

a metallic oxidation-resistant bond layer covering a surface of the article;

a columnar ceramic layer formed on the bond layer by a physical vapor deposition technique; and an erosion-resistant composition present in the thermal barrier coating so as to inhibit erosion of the columnar ceramic layer, the erosion-resistant composition consisting essentially of a material chosen from the group consisting of silicon carbide and alumina.

2. A thermal barrier coating as recited in claim 1 wherein the erosion-resistant composition is a wear coating overlaying the columnar ceramic layer so as to serve as a physical barrier to particulate impact and erosion of the columnar ceramic layer.

3. A thermal barrier coating as recited in claim 2 wherein the columnar ceramic layer consists essentially of zirconia stabilized by about 6 to about 8 weight percent yttria.

4. A thermal barrier coating as recited in claim 2 wherein the thermal barrier coating further comprises at least a second columnar ceramic layer overlaying the erosion-resistant composition and at least a second erosion-resistant composition overlaying the second columnar ceramic layer.

5. A thermal barrier coating as recited in claim 1 wherein the erosion-resistant composition is dispersed in the columnar ceramic layer so as to render the columnar ceramic layer more resistant to erosion.

6. A thermal barrier coating as recited in claim 5 wherein the columnar ceramic layer consists essentially of yttria-stabilized zirconia and the erosion-resistant composition, the erosion-resistant composition being alumina and constituting up to about 45 weight percent of the columnar ceramic layer.

7. A thermal barrier coating as recited in claim 1 wherein the bond layer has an average surface roughness $R_a$ of not more than about two micrometers.

8. A thermal barrier coating as recited in claim 1 wherein the erosion-resistant composition is deposited by a physical or chemical vapor deposition technique.

9. An impact and erosion-resistant thermal barrier coating formed on a superalloy article subjected to erosion and wear, the thermal barrier coating comprising:

a metallic oxidation-resistant bond layer covering a surface of the superalloy article;

a columnar ceramic layer formed on the bond layer by a physical vapor deposition technique, the columnar ceramic layer comprising yttria-stabilized zirconia; and an erosion-resistant coating formed on the columnar ceramic layer so as to serve as a physical barrier to erosion of the columnar ceramic layer, the erosion-resistant composition consisting essentially of a material chosen from the group consisting of silicon carbide and alumina.

10. A thermal barrier coating as recited in claim 9 wherein the columnar ceramic layer consists essentially of zirconia stabilized by about 6 to about 8 weight percent yttria.

11. A thermal barrier coating as recited in claim 9 wherein the thermal barrier coating further comprises at least a second columnar ceramic layer overlaying the erosion-resistant composition and at least a second erosion-resistant composition overlaying the second columnar ceramic layer.

12. A thermal barrier coating as recited in claim 9 wherein the bond layer has an average surface roughness $R_a$ of not more than about two micrometers.

13. An impact and erosion-resistant thermal barrier coating formed on a superalloy article subjected to erosion and wear, the thermal barrier coating comprising:

a metallic oxidation-resistant bond layer covering a surface of the superalloy article;

a columnar ceramic layer formed on the bond layer by a physical vapor deposition technique, the columnar ceramic layer comprising zirconia; and an erosion-resistant composition dispersed in the columnar ceramic layer so as to render the columnar ceramic layer more resistant to erosion, the erosion-resistant composition consisting essentially of alumina.

14. A thermal barrier coating as recited in claim 13 wherein the zirconia of the columnar ceramic layer is stabilized with yttria, and the erosion-resistant composition constitutes up to about 45 weight percent of the columnar ceramic layer.

15. A thermal barrier coating as recited in claim 13 wherein the bond layer has an average surface roughness $R_a$ of not more than about two micrometers.

16. A method for forming an impact and erosion-resistant thermal barrier layer on an article, the method comprising the steps of:

forming a metallic oxidation-resistant bond layer on a surface of the article;

forming a columnar ceramic layer on the bond layer by a physical vapor deposition technique; and providing an erosion-resistant composition in the thermal barrier coating so as to inhibit erosion of the columnar ceramic layer, the erosion-resistant composition consisting essentially of a material chosen from the group consisting of silicon carbide and alumina.

17. A method as recited in claim 16 wherein the step of forming the bond layer results in the bond layer having an average surface roughness $R_a$ of not more than about two micrometers.

18. A method as recited in claim 16 wherein the step of forming the columnar ceramic layer includes maintaining the article stationary while depositing the columnar ceramic layer using the physical vapor deposition technique.

19. A method as recited in claim 16 wherein the step of providing the erosion-resistant composition entails forming a layer of the erosion-resistant composition over the columnar ceramic layer.

20. A method as recited in claim 16 wherein the step of providing the erosion-resistant composition entails forming a dispersion of particles of the erosion-resistant composition in the columnar ceramic layer.

* * * * *